US010686252B2

(12) United States Patent
Yong et al.

(10) Patent No.: US 10,686,252 B2
(45) Date of Patent: Jun. 16, 2020

(54) ELECTRONIC DEVICE WITH PATCH ANTENNA

(71) Applicant: Apple Inc., Cupertino, CA (US)

(72) Inventors: Siwen Yong, Santa Clara, CA (US); Qingxiang Li, Mountain View, CA (US); Yi Jiang, Sunnyvale, CA (US); Robert W. Schlub, Cupertino, CA (US); Umar Azad, San Jose, CA (US); Rodney A. Gomez Angulo, Sunnyvale, CA (US); Enrique Ayala Vazquez, Watsonville, CA (US)

(73) Assignee: Apple Inc., Cupertino, CA (US)

( * ) Notice: Subject to any disclaimer, the term of this patent is extended or adjusted under 35 U.S.C. 154(b) by 362 days.

(21) Appl. No.: 14/306,024

(22) Filed: Jun. 16, 2014

(65) Prior Publication Data

US 2015/0364815 A1 Dec. 17, 2015

(51) Int. Cl.
*H01Q 1/24* (2006.01)
*H01Q 9/04* (2006.01)
*H01Q 1/44* (2006.01)

(52) U.S. Cl.
CPC ..... *H01Q 9/0407* (2013.01); *H01Q 1/243* (2013.01); *H01Q 1/44* (2013.01)

(58) Field of Classification Search
CPC ..... H01Q 1/50; H01Q 1/24
USPC ..... 343/702
See application file for complete search history.

(56) References Cited

U.S. PATENT DOCUMENTS 4,614,937 A * 9/1986 Poujois ..... H03K 17/9622 200/5 A
5,146,615 A * 9/1992 Hodsdon ..... H04B 1/3833 345/168
5,572,239 A * 11/1996 Jaeger ..... G02F 1/13306 345/172
5,652,595 A 7/1997 Ahrens et al.
5,901,834 A * 5/1999 Inubushi ..... H01H 13/702 200/314

(Continued)

FOREIGN PATENT DOCUMENTS

EP 2311138 1/2009

OTHER PUBLICATIONS

Tan et al., U.S. Appl. No. 14/339,366, filed Jul. 23, 2014.

*Primary Examiner* — Hai V Tran
*Assistant Examiner* — Bamidele A Jegede
(74) *Attorney, Agent, or Firm* — Treyz Law Group, P.C.; G. Victor Treyz; Tianyi He

(57) ABSTRACT

An electronic device may be provided with wireless circuitry that includes a radio-frequency transceiver circuit and an antenna. The antenna may be a patch antenna formed from a patch antenna resonating element and an antenna ground. The patch antenna resonating element may be formed from a metal patch on a printed circuit board. The antenna ground may be formed from a metal housing having a planar rear wall that lies in a plane parallel to the metal patch. The radio-frequency transceiver circuit may be coupled to the metal patch through traces on the printed circuit and may be coupled to rear wall of the housing through a screw and a screw boss in the housing. Buttons and other electrical components may be mounted on the printed circuit board and may be coupled to control circuitry on the printed circuit board through the metal patch.

20 Claims, 10 Drawing Sheets

(56) References Cited

U.S. PATENT DOCUMENTS 6,545,642 B1 * 4/2003 Doub ..... H01Q 1/243 343/700 MS
6,646,610 B2 11/2003 Troelsen
7,280,075 B2 * 10/2007 Koyama ..... H01Q 1/2283 343/702
7,671,803 B2 3/2010 Neill et al.
8,611,953 B2 12/2013 Jordan et al.
2004/0118670 A1 * 6/2004 Park ..... H01H 25/041 200/344
2006/0172785 A1 * 8/2006 Phillips ..... H01Q 1/243 455/575.1
2008/0074329 A1 * 3/2008 Caballero ..... H01Q 1/088 343/702
2009/0143110 A1 * 6/2009 Armstrong ..... G06F 3/0338 455/566
2010/0213043 A1 * 8/2010 Chen ..... H01H 13/705 200/5 A
2011/0006954 A1 * 1/2011 Seo ..... H01Q 1/243 343/702
2011/0050509 A1 * 3/2011 Ayala Vazquez .... H01Q 1/2266 343/702
2011/0132736 A1 * 6/2011 Mittleman ..... H01H 13/79 200/345
2011/0199283 A1 * 8/2011 Togashi ..... H01Q 1/243 343/904
2011/0255260 A1 * 10/2011 Weber ..... H04M 1/026 361/807
2012/0050114 A1 * 3/2012 Li ..... H01Q 1/2266 343/702
2012/0081240 A1 * 4/2012 Choi ..... G06F 1/1626 341/22
2012/0146817 A1 * 6/2012 Tang ..... H01H 13/705 341/22
2012/0223865 A1 * 9/2012 Li ..... H01Q 1/243 343/702
2013/0050046 A1 * 2/2013 Jarvis ..... H01Q 1/243 343/852
2013/0079069 A1 * 3/2013 Kwon ..... H01Q 1/243 455/575.5
2013/0149975 A1 * 6/2013 Yu ..... H04B 7/0602 455/78
2014/0071634 A1 * 3/2014 Pakula ..... H01M 2/1022 361/748
2014/0112511 A1 * 4/2014 Corbin ..... H05K 9/006 381/333
2014/0159989 A1 * 6/2014 Malek ..... H01Q 1/243 343/876
2015/0270619 A1 * 9/2015 Zhu ..... G01V 3/00 343/702

* cited by examiner

ELECTRONIC DEVICE WITH PATCH ANTENNA

BACKGROUND

This relates generally to electronic devices and, more particularly, to electronic devices with wireless communications circuitry.

Electronic devices often include wireless communications circuitry. Radio-frequency transceivers are coupled to antennas to support communications with external equipment. During operation, a radio-frequency transceiver uses an antenna to transmit and receive wireless signals.

It can be challenging to incorporate wireless components such as antenna structures within an electronic device. If care is not taken, an antenna may consume more space within a device than desired, may exhibit unsatisfactory wireless performance, or may interfere with the operation of control circuitry in a device.

It would therefore be desirable to be able to provide improved antennas for electronic devices.

SUMMARY

An electronic device may be provided with wireless circuitry. The electronic device may be a remote control or other device that uses wireless communications to interact with external electronic equipment. Buttons, a touch pad, and other input-output devices in the remote control may be used to gather input from a user.

The wireless circuitry may include a radio-frequency transceiver circuit and an antenna. The antenna may be a patch antenna formed from a patch antenna resonating element and an antenna ground. The patch antenna resonating element may be formed from a metal patch on a printed circuit board. The metal patch may be a rectangular patch formed from a patterned metal trace on the printed circuit board.

The antenna ground may be formed from a metal housing such as a metal housing having a planar rear wall that lies in a plane parallel to the metal patch. Components for the remote control or other device may be mounted in the housing. For example, the touch pad may be mounted in the housing, the printed circuit may be mounted in the housing, buttons may be mounted in the housing, a battery may be mounted in the housing, and other circuitry may be mounted in the housing.

The radio-frequency transceiver circuit may be coupled to the metal patch through traces on the printed circuit and may be coupled to rear wall of the housing through a screw and a screw boss in the housing. Buttons and other electrical components may be mounted on the printed circuit board and may be coupled to control circuitry on the printed circuit board through the metal patch. Inductors may be interposed in signal paths between the control circuitry and the buttons to block radio-frequency signals from the radio-frequency transceiver circuit.

DETAILED DESCRIPTION

Figure 1:
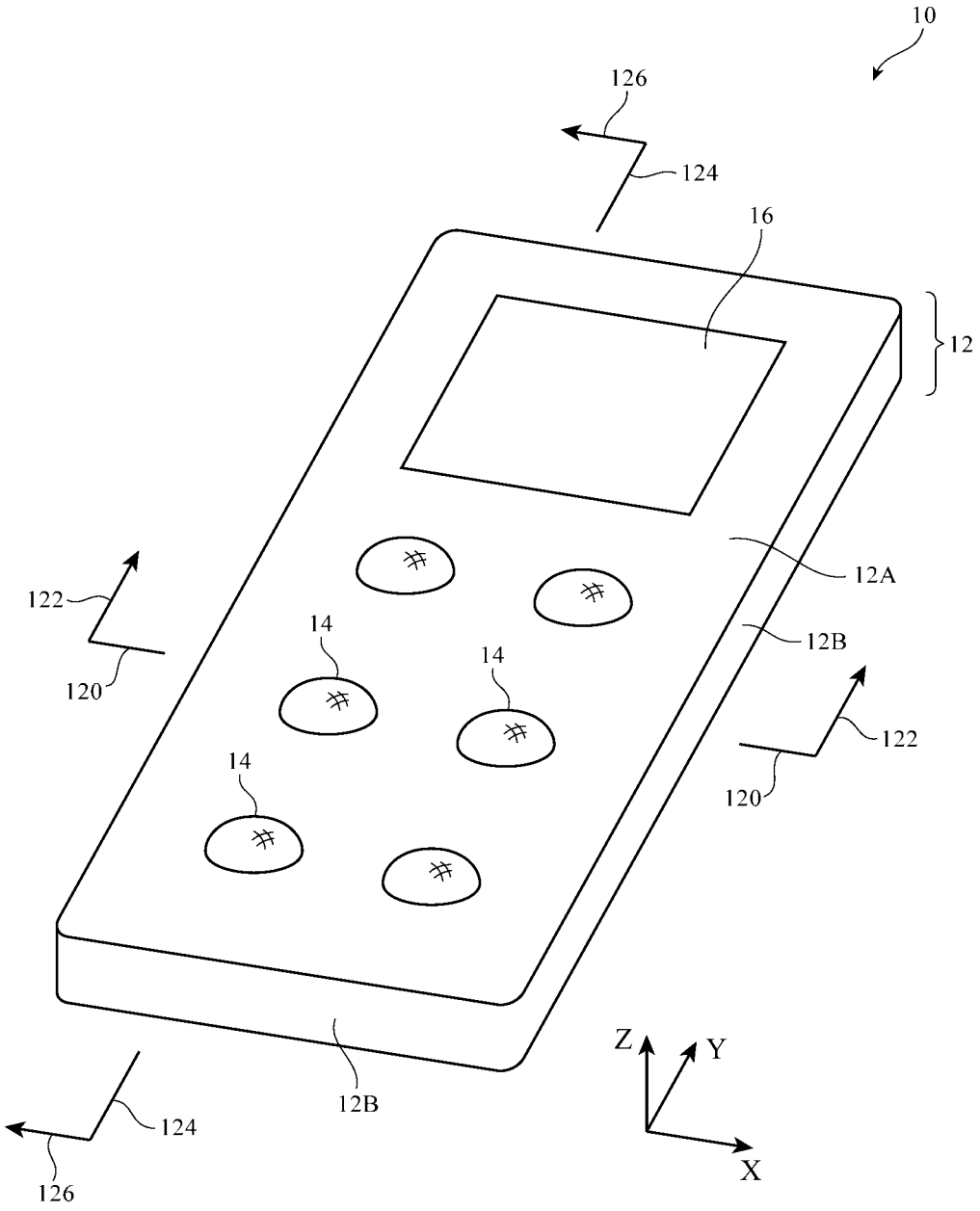
FIG. 1 is a perspective view of an illustrative electronic device with wireless communications circuitry in accordance with an embodiment.

An electronic device such as electronic device 10 of FIG. 1 may contain wireless circuitry. The wireless circuitry may be used to wirelessly communicate with external equipment such as a computer, a television, a set-top box, a media player, a display, a wearable device, a cellular telephone, or other electronic equipment. Electronic device 10 may be a remote control or other electronic device (e.g., a portable device, a computing device, an accessory for controlling a computer such as a wireless trackpad or wireless mouse, etc.). Illustrative configurations for device 10 in which device 10 includes components that allow device 10 to serve as a remote control for controlling external equipment are sometimes described herein as an example. This is, however, merely illustrative. Device 10 may be any suitable electronic equipment.

Device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications, light-based wireless communications (e.g., infrared light communications and/or visible light communications), satellite navigation system communications, or other wireless communications. Illustrative configurations for the wireless circuitry of device 10 in which wireless communications are performed over a 2.4 GHz communications band (e.g., a Bluetooth® or WiFi® link) are sometimes described herein as an example.

As shown in FIG. 1, device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). With one illustrative configuration, housing 12 may include a rear portion such as portion 12B and a front portion such as front portion 12A. Rear portion 12B may include a rear wall (e.g., a planar wall) and four sidewalls that run along each of the four edges of the rear wall. The sidewalls may be curved, may be planar, or may have other suitable shapes. The sidewalls of the rear portion of housing 12 may, if desired, form smooth continuously extending portions of rear housing 12B. Configurations for device 10 in which the sidewalls for housing 12 extend vertically upwards (dimension Z in the diagram of FIG. 1) may also be used. Front housing portion 12A may extend over some or all of the front surface of housing 12, as shown in FIG. 1. Housing portion 12A may be formed from plastic or other suitable materials (e.g., one or more different plastics, a single plastic, plastic and metal, etc.). The use of dielectric materials to cover the front of housing 12 allows wireless signals to be transmitted and received through the front of housing 12.

Device 10 may include buttons such as buttons 14. There may be any suitable number of buttons 14 in device 10 (e.g., a single button 14, more than one button 14, two or more buttons 14, five or more buttons 14, six or more buttons 14, etc.). Buttons 14 may be formed from dome switches or other switches mounted in housing 12. If desired, some or all of housing 12A may be formed from an elastomeric polymer material to allow buttons 14 to be depressed by a user. Buttons 14 may be organized to form a directional pad (D-pad) or other control pad, may include up and down buttons, may be arranged to allow control of functions such as media volume, channel selection, page up and down, menu back/forward, playback reverse, pause, stop, and forward, fast forwards and fast reverse, time period skip, cancel, enter, etc., may include number keys and/or letter keys, may be associated with dedicated functions for a set-top box, television, or other equipment, may include a power button for turning off and turning on remote equipment, or may have other suitable functions. The six-button layout of FIG. 1 is merely illustrative.

If desired, device 10 may include one or more input-output devices such as input-output device 16. Input-output device 16 may include a display such as a liquid crystal display, organic light-emitting diode display, electrophoretic display, or other visual output component. Alternatively, or in combination with a visual output component, input-output device 16 may include a touch sensor. For example, input-output device 16 may be a touch pad or other component that incorporates a touch sensor array to gather touch input from a user. A user may, for example, supply touch input using one or more fingers. Touch input may include single-finger commands and/or multi-finger gestures (e.g., swipes, pinch to zoom commands, etc.). The touch sensor array of device 16 may include a capacitive touch sensor array or may include touch sensor components based on other touch technologies (e.g., resistive touch, acoustic touch, force-based touch, light-based touch, etc.).

Figure 2:
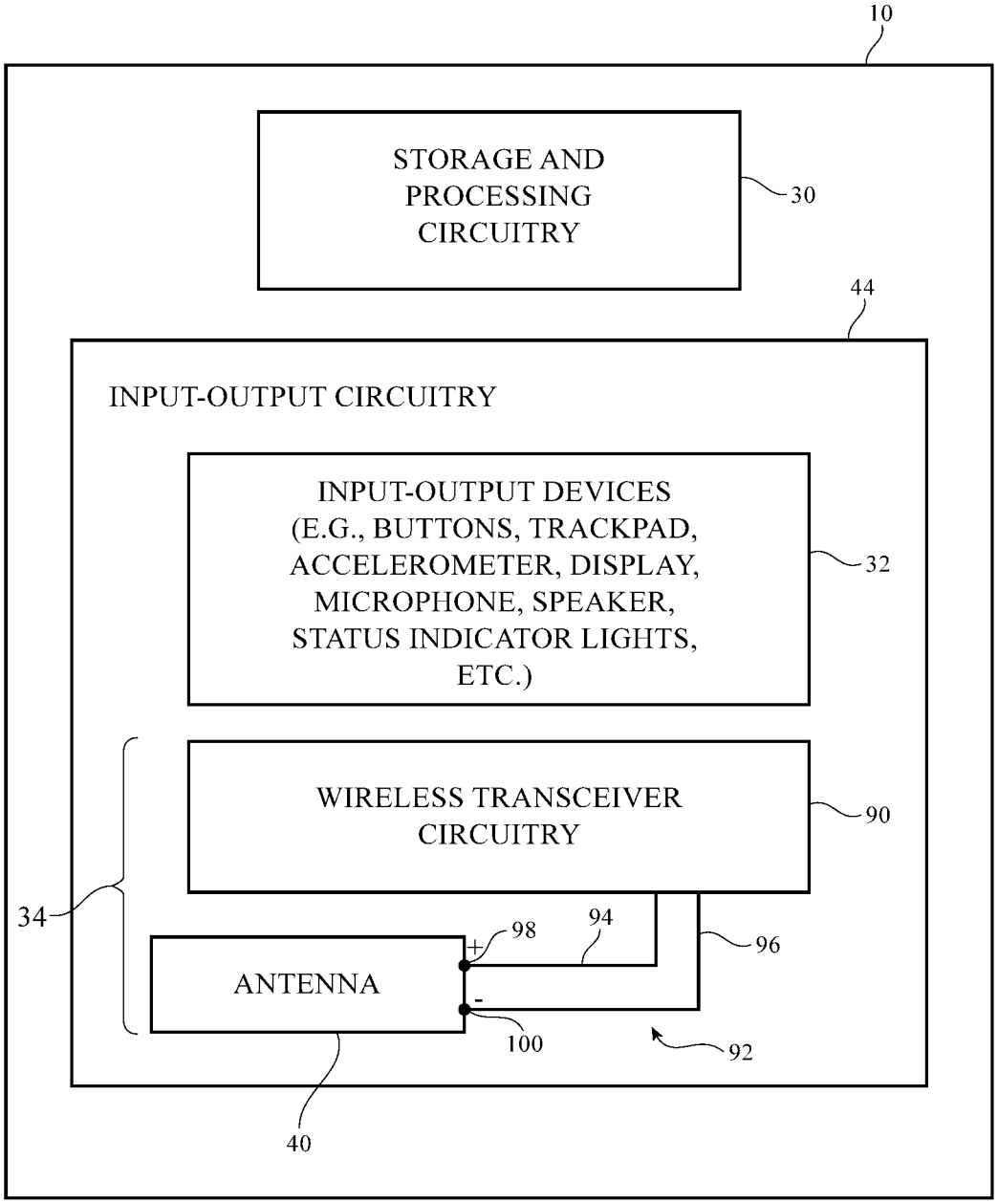
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10. For example, software running on device 10 may be used to process input commands from a user that are supplied using input-output components such as buttons 14, touch pad (track pad) 16, and other input-output circuitry. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons (e.g., buttons 14), joysticks, click wheels, scrolling wheels, touch pads (e.g., touch pad 16), key pads, keyboards, microphones, cameras, buttons, speakers, status indicators, light sources, audio jacks and other audio port components, digital data port devices, light sensors, motion sensors (accelerometers), capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include wireless local area network transceiver circuitry that may handle 2.4 GHz and 5 GHz bands for WiFi® (IEEE 802.11) communications, wireless transceiver circuitry that may handle the 2.4 GHz Bluetooth® communications band, cellular telephone transceiver circuitry for handling wireless communications in communications bands between 700 MHz and 2700 MHz or other suitable frequencies (as examples), or other wireless communications circuits. If desired, wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, satellite navigation system receiver circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. To conserve power, it may be desirable in some embodiments to configure wireless communications circuitry 34 so that transceiver 90 handles exclusively short-range wireless links such as 2.4 GHz links (e.g., Bluetooth® and/or WiFi® links). Other configurations may be used for wireless circuitry 34 if desired (e.g., configurations with coverage in additional communications bands).

Wireless communications circuitry 34 may include one or more antennas such as antenna 40. Antenna 40 may be formed using any suitable antenna type. For example, antenna 40 may be an antenna with a resonating element that is formed from loop antenna structures, patch antenna structures, inverted-F antenna structures, slot antenna structures, planar inverted-F antenna structures, helical antenna structures, hybrids of these designs, etc. If desired, antenna 40 may be a cavity-backed antenna (e.g., an antenna in which the ground plane has the shape of a cavity). Patch antenna structures may be configured to exhibit lateral antenna currents that help enhance polarization insensitivity and help reduce directional sensitivity.

Transmission line paths such as transmission line 92 may be used to couple antenna 40 to transceiver circuitry 90. Transmission line 92 may be coupled to antenna feed structures associated with antenna structures 40. As an example, antenna structures 40 may form a patch antenna or other type of antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 2 is merely illustrative. Transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. Circuits for impedance matching circuitry may be formed from discrete components (e.g., surface mount technology components) or may be formed from housing structures, printed circuit board structures, traces on plastic supports, etc. Components such as these may also be used in forming filter circuitry.

Figure 3:
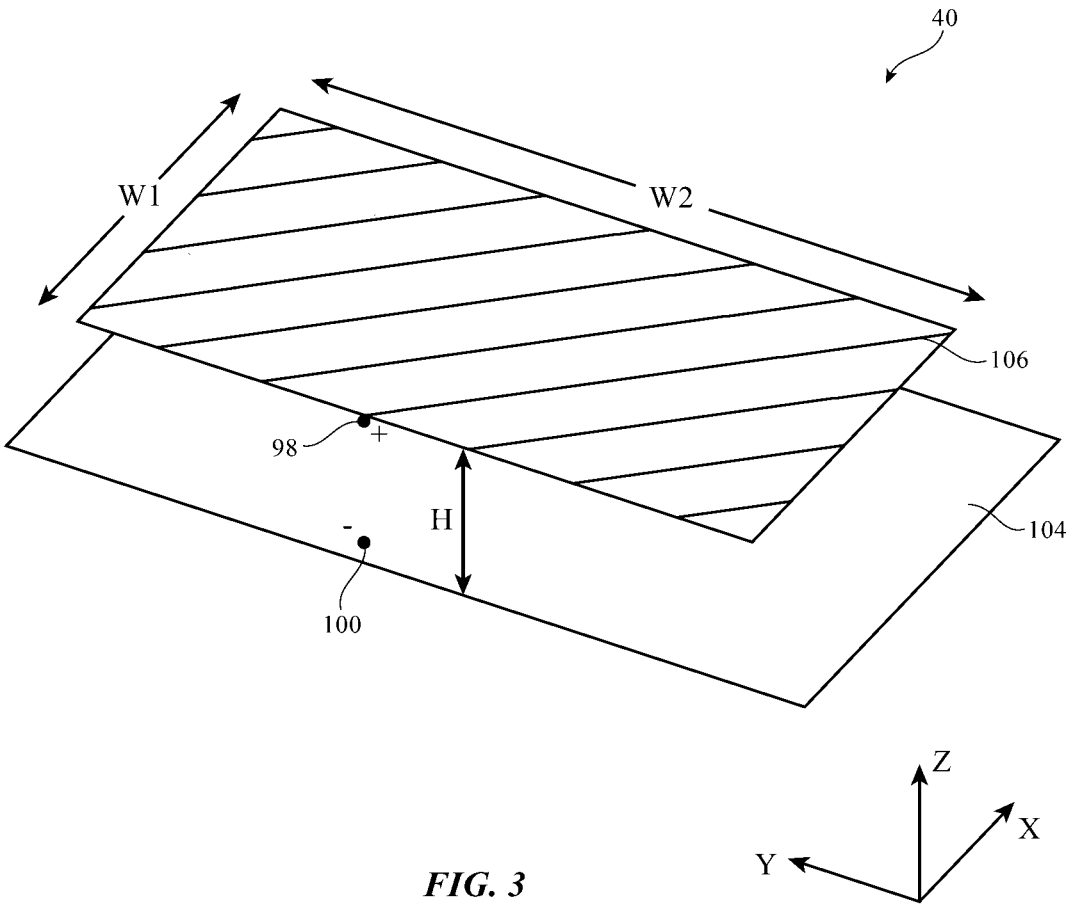
FIG. 3 is a perspective view of an illustrative antenna in accordance with an embodiment.

FIG. 3 is a diagram of illustrative patch antenna structures that may be used in implementing antenna 40 for device 10. Patch antenna 40 of FIG. 3 has an antenna resonating element such as patch antenna resonating element 106 and antenna ground (ground plane) 104. Resonating element 106 may be formed from metal traces on a printed circuit, metal foil, or other conductive structures. Resonating element 106 may lie in a plane that is parallel to ground plane 104. Ground plane 104 may be formed using metal traces on a printed circuit, metal device housing structures such as a metal rear housing wall in a housing that is partly or completely formed from metal, or may be formed from other antenna ground structures. For example, ground plane 104 may be formed from a metal rear housing wall that lies in a plane that is parallel to a plane containing patch antenna resonating element 106.

Antenna resonating element 106 may have a rectangular shape or other planar (patch) shape and may lie in the horizontal (X-Y) plane of FIG. 3. Resonating element 106 may have lateral dimensions W1 and W2. The values of dimensions W1 and W2 may be selected to be a half of a wavelength at an operating frequency of interest (to help enhance antenna efficiency) or may be less than a half of a wavelength in length (to help minimize the size of device 10). A half of a wavelength at 2.4 GHz is about 2.5 inches. With one arrangement, W1 and/or W2 are less than 2.5 inches.

Axis Y of FIG. 3 may form the longitudinal axis of resonating element 106 and may also serve as the longitudinal axis of device 10 and housing 12 (see, e.g., FIG. 1). The size of patch resonating element 106 of FIG. 3 in dimension X (e.g., width W1) may be substantially equal to the width of device 10. The size of element 106 in dimension Y (e.g., dimension W2) may be equal to the length of housing 12 or may be less than the length of housing 12 (e.g., 70% or less, 50% or less, etc.). A vertical distance such as height H may separate resonating element patch 106 from antenna ground 104 in vertical dimension Z. The magnitude of H may be 2-3 mm, 1-5 mm, or other suitable size.

With one suitable arrangement, antenna resonating element patch 106 may be formed from traces on a printed circuit. The traces may form a direct-current (DC) ground for integrated circuits and electrical components on the printed circuit (i.e., a DC ground). The same traces (i.e., the DC ground) may form antenna resonating element patch 106. Antenna 40 may have an antenna feed formed from positive antenna feed terminal 98 and ground antenna feed terminal 100. Positive antenna feed terminal 98 may be coupled to resonating element patch 106. Ground antenna feed terminal 100 may be coupled to antenna ground 104.

Figure 4:
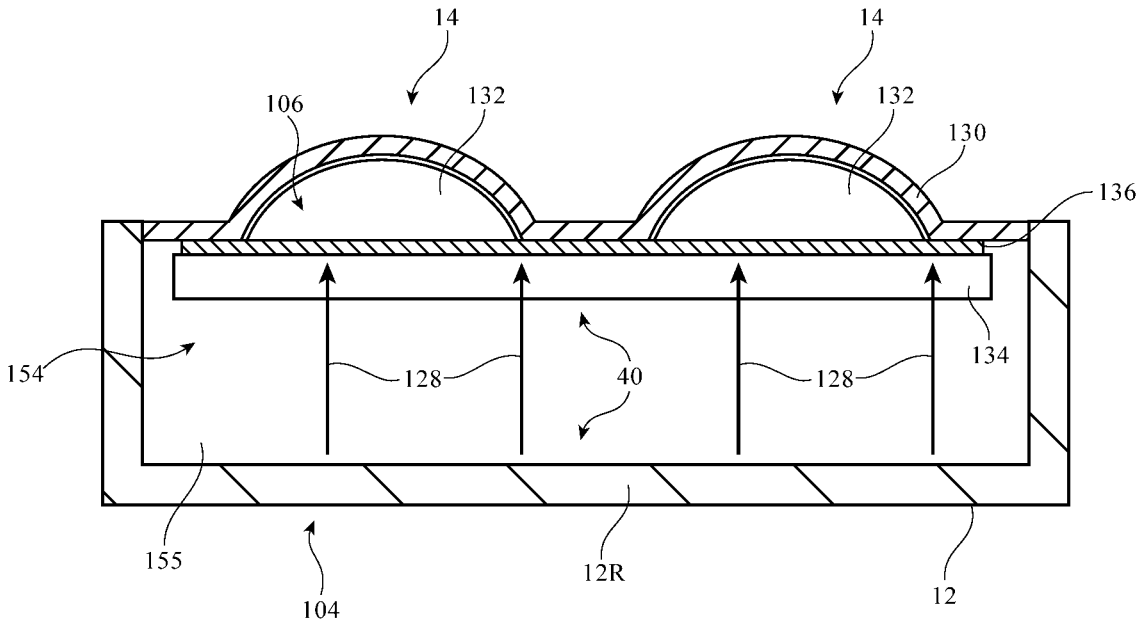
FIG. 4 is a cross-sectional view of an electronic device of the type shown in FIG. 1 showing how an antenna may be incorporated into the device in accordance with an embodiment.

A cross-sectional view of device 10 taken along line 120 and viewed in direction 122 of FIG. 1 is shown in FIG. 4. As shown in FIG. 4, patch antenna 40 may be formed from antenna resonating element 106 and antenna ground 104. Antenna resonating element 106 may be formed from metal trace(s) 136. Metal traces 136 may be formed from one or more metal layers on a printed circuit substrate. As shown in FIG. 4, for example, metal traces 136 may be formed on the uppermost layer of printed circuit substrate 134 in printed circuit 154. Printed circuit 154 may be a rigid printed circuit board (e.g., printed circuit substrate 134 may be formed from a rigid printed circuit board material such as fiberglass-filled epoxy) or may be a flexible printed circuit (e.g., printed circuit substrate 134 may be formed from a sheet of polyimide or other flexible polymer layer).

Antenna ground 104 may be formed from metal device structures such as a metal housing (e.g., a metal housing 12 having metal rear housing wall 12R). Dielectric-filled cavity 155 (e.g., a space filled with air, plastic, foam, or other dielectric materials) may separate resonating element 106 from metal rear housing wall 12R. During operation of antenna 40, antenna signals may establish electric field lines 128 extending between antenna ground 104 and resonating element 106.

Antenna resonating element 106 may be formed from metal or other conductive material. In configurations of the type shown in FIG. 4 in which antenna resonating element 106 is formed from metal traces 136 in a printed circuit such as printed circuit 154, metal traces 136 may serve both to form antenna resonating element 106 and to form a direct-current (DC) ground for non-radio-frequency circuitry in device 10. As an example, metal traces 136 may serve to carry DC button signals associated with buttons 14 to control circuitry 30 in device 10. Each button 14 may have an associated switch 132 that is electrically coupled to metal layer 136. Switches 132 may be dome switches or other switches that are covered with a protective layer such as a layer of plastic. As shown in FIG. 4, for example, elastomeric plastic layer 130 may serve as a cover layer that overlaps dome switches 132 of buttons 14.

Figure 5:
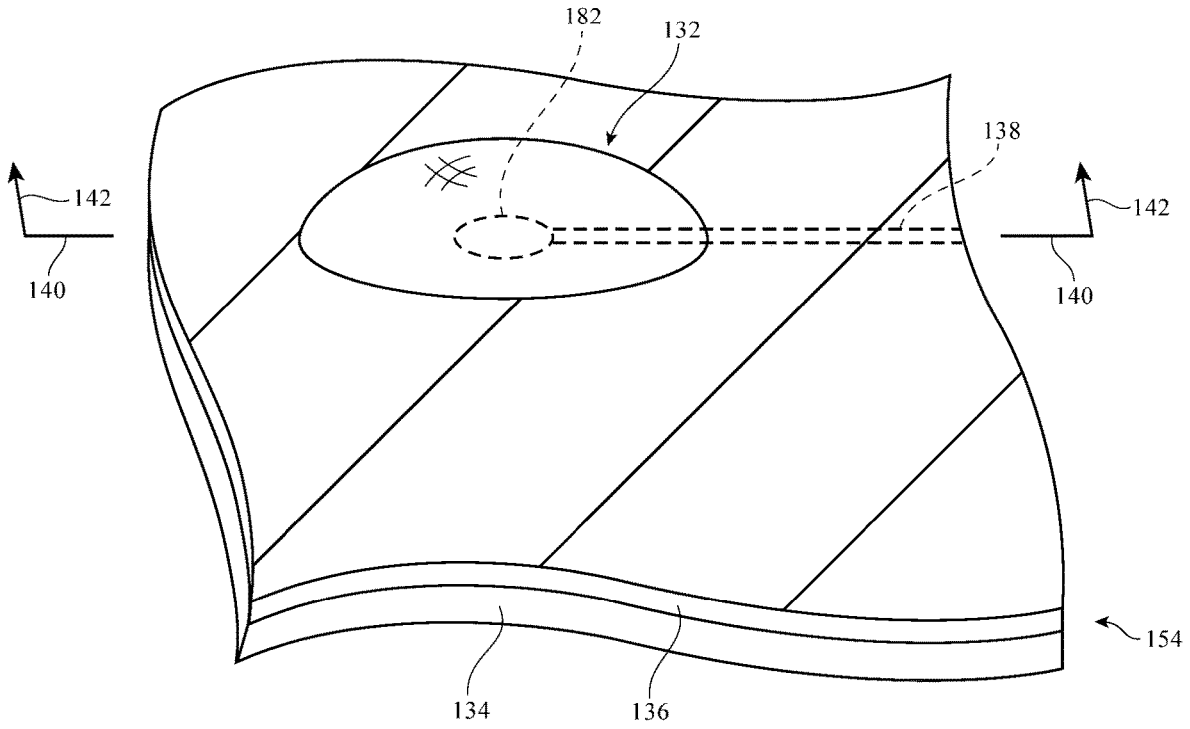
FIG. 5 is a perspective view of an illustrative dome switch mounted to a printed circuit in accordance with an embodiment.

FIG. 5 is a perspective view of an illustrative configuration that may be used for dome switch 132. As shown in FIG. 5, dome switch 132 may be mounted on printed circuit 154. Printed circuit 154 may include substrate 134 and metal layer 136. Metal layer 136 may serve as a signal path for DC button signals for one or more buttons 14 (e.g., a DC ground). With this type of arrangement, multiple buttons 132 may be coupled to a common ground (DC ground plane 136). Each button may also be associated with a respective button signal trace such as illustrative trace 138 of FIG. 5. Trace 138 may be coupled to a central button electrode such as electrode 182.

Each button 14 may have a respective dome switch 132 and each dome switch may have a pair of electrodes. The pair of electrodes for each dome switch may include ground layer 136, which may form a common button electrode that is shared between multiple buttons) and a button-specific electrode such as illustrative electrode 182 of switch 132 in FIG. 5.

Figure 6:
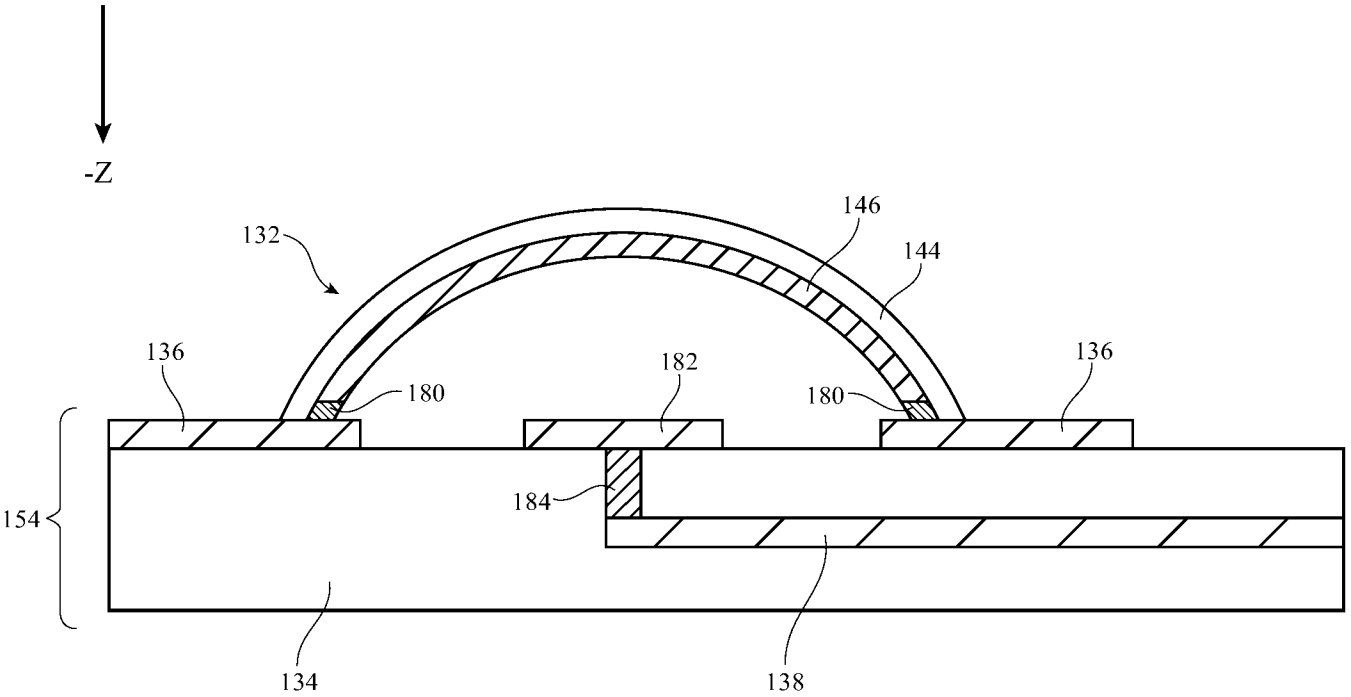
FIG. 6 is a cross-sectional side view of the illustrative dome switch of FIG. 5 in accordance with an embodiment.

A cross-sectional side view of dome switch 132 and printed circuit 154 of FIG. 5 is shown in FIG. 6. As shown in FIG. 6, dome switch 132 may have a compressible dome member such as member 144. Member 144 may be formed from a material such as plastic. During operation, a user may press downwards in direction −Z so that the member 144 collapses against the upper surface of printed circuit 154. A metal sheet or coating such as metal coating 146 may be formed on the inner surface of dome member 144. The metal coating may be shorted to metal layer 136 on printed circuit substrate 134 in printed circuit 154 using solder 180 or other electrical coupling mechanism (i.e., in the open state for button 14, metal coating layer 146 may be shorted to the outer electrode of switch 132). When compressed downwards, coating 146 may short central dome switch electrode 182 to the outer electrode formed from layer 136. Central electrode 182 may be coupled to metal via 184 and horizontal signal trace 138. Trace 138 and metal layer 136 may be coupled to button controller circuitry in storage and processing circuitry 30 (FIG. 2).

Figure 7:
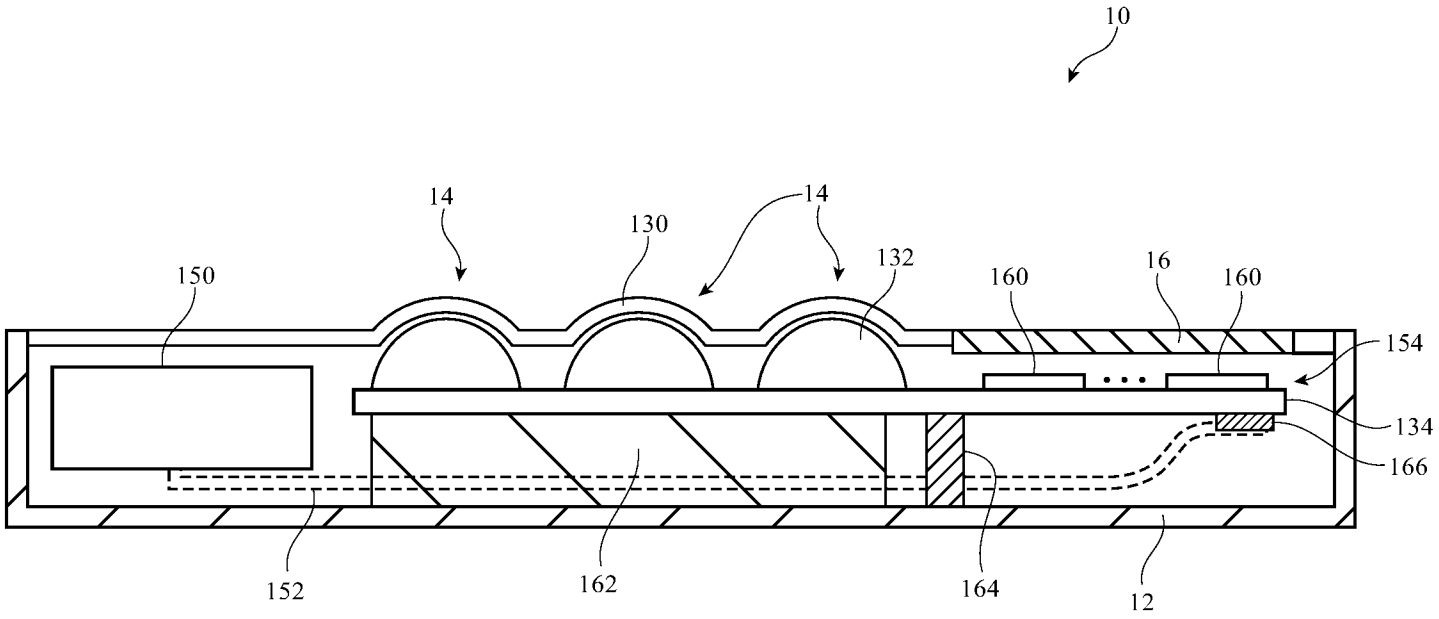
FIG. 7 is a cross-sectional side view of an illustrative electronic device of the type shown in FIG. 1 showing how internal components of the electronic device may be arranged within the device in accordance with an embodiment.

FIG. 7 is a cross-sectional side view of device 10 of FIG. 1 taken along line 124 and viewed in direction 126 of FIG. 1. As shown in FIG. 7, components such as buttons 14 and touch pad 16 or other input-output devices that are operated by a user of device 10 may be mounted in housing 12 along the front of device 10 (i.e., the upper surface of device 10 in the orientation of FIG. 7). Elastomeric covering member 130 may cover dome switches 132 and, if desired, other portions of the front of device 10. Battery 150 may be located within housing 12. Flexible printed circuit cable 152 or other signal paths may be used to couple battery 150 and other components in device 10 to printed circuit board 154. Flexible printed circuit cable 152 may be coupled to metal traces in printed circuit substrate 134 using board-to-board connector 166 or other coupling mechanism.

Integrated circuits and other components (see, e.g., components 160, which may form control circuitry 30 and input-output circuitry 44) may be mounted on printed circuit board 134 using solder. Dielectric carrier 162 (e.g., a foam support structure or a support structure formed from hollow molded plastic or other dielectric materials) may be mounted to housing 12 and may be used to support printed circuit 154 under buttons 14.

Figure 8:
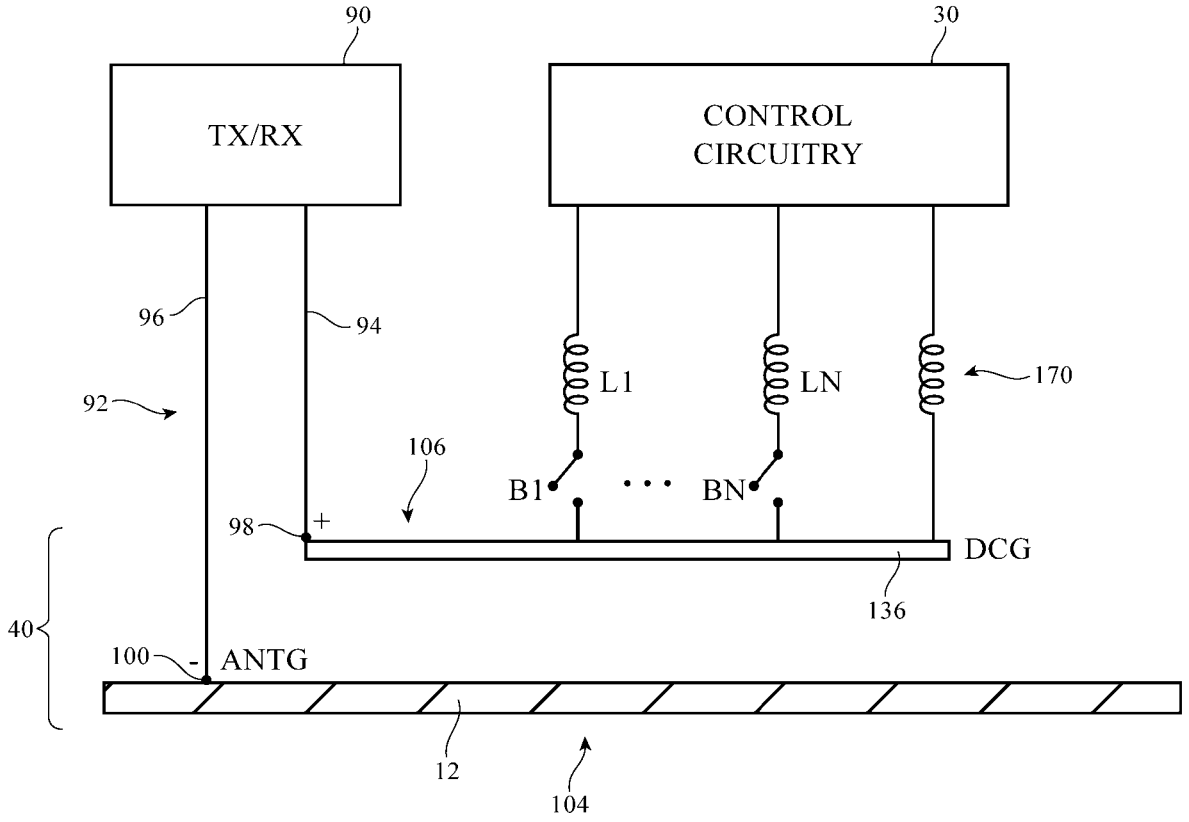
FIG. 8 is a diagram showing how radio-frequency transceiver circuitry and control circuits in an electronic device may be coupled to metal structures in an electronic device in accordance with an embodiment.

Control circuitry 30 and wireless transceiver circuitry 90 may be coupled to metal traces 136 using circuitry of the type shown in FIG. 8. As shown in FIG. 8, control circuitry 30 may be coupled to buttons 14 (e.g., buttons B1 . . . BN) using respective inductors L1 . . . LN. Inductor 170 may be coupled directly to metal layer 136. When a given switch is depressed, the switch will be closed and will form a short circuit through the inductor associated with the given switch, through the given switch, through metal layer 136, and through the path containing inductor 170. Inductors L1 . . . LN and inductor 170 may serve as low pass filters that prevent high-frequency signals such as radio-frequency signals associated with operation of transceiver circuitry 90 and antenna 40 from interfering with the operation of control circuitry 30. Metal layer 136 may have the shape of patch antenna resonating element 106 of FIG. 3 (e.g., a rectangular patch shape that fits within housing 12) or may have other suitable shapes. Layer 136 may serve both as antenna resonating element 106 and as DC ground (DCG) for control circuitry 30 and buttons 14.

Wireless radio-frequency transceiver circuitry 90 may be coupled to antenna 40 using transmission line 92. Transmission line 92 may have a positive signal path such as path 94 that is coupled to positive antenna feed terminal 98 of antenna 40. Transmission line 92 may also have a ground signal path such as path 96 that is coupled to ground antenna feed terminal 100. Terminal 98 may be coupled to antenna resonating element 106, which is formed from metal layer 136. Terminal 100 may be coupled to antenna ground (ANTG), which is formed from metal housing 12 or other structure for forming antenna ground plane 104.

Figure 9:
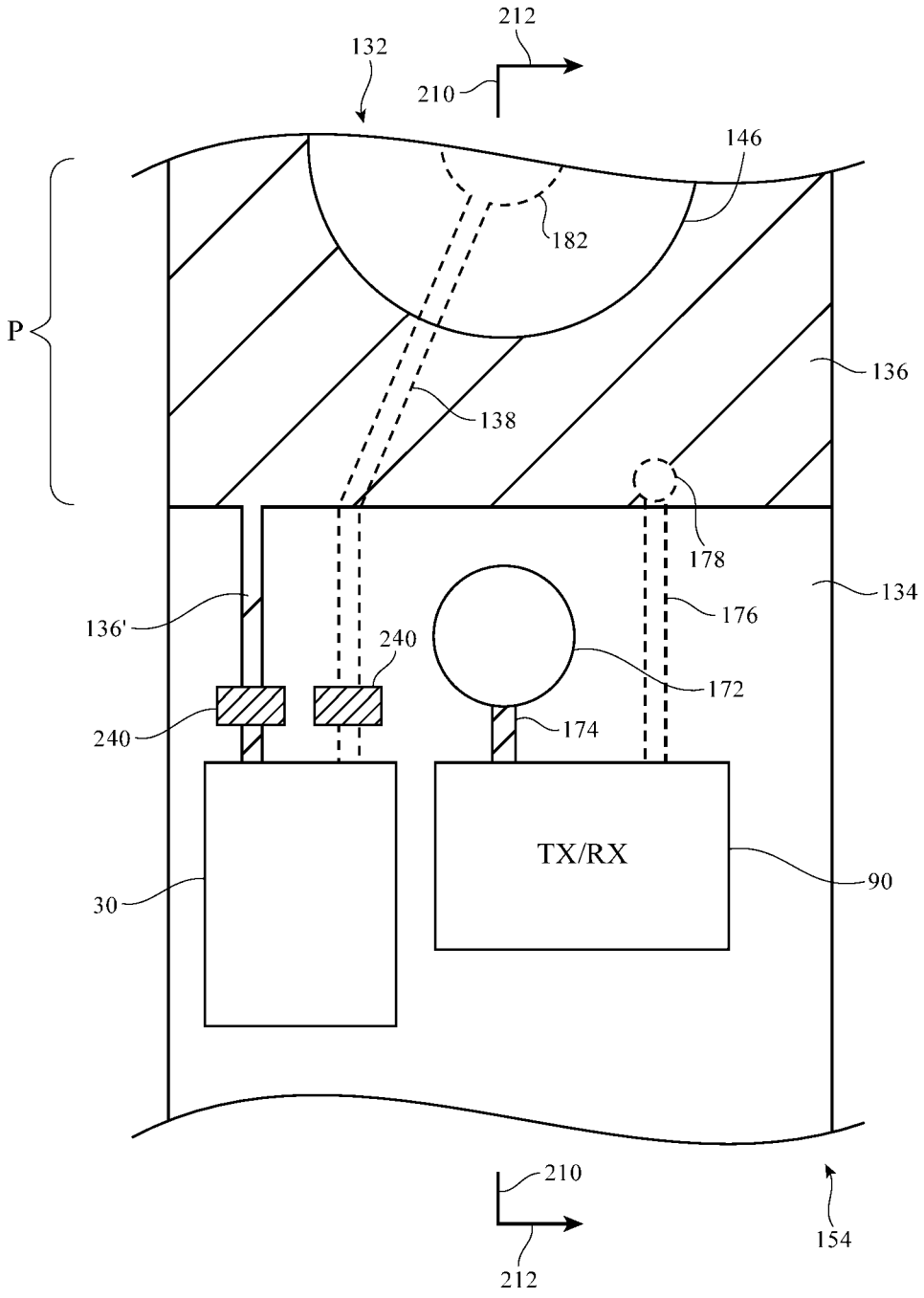
FIG. 9 is a top view of an illustrative printed circuit having metal traces that are being used as part of an antenna and as part of a button ground in accordance with an embodiment.

FIG. 9 is a top view of printed circuit 154 showing how control circuitry 30 and wireless transceiver circuitry 90 may be interconnected with metal patch 136 and other structures on printed circuit 154. A single dome switch 132 is shown in FIG. 9, but multiple dome switches 132 may be mounted on printed circuit 154 if desired.

As shown in FIG. 9, control circuitry 30 (e.g., one or more integrated circuits) and radio-frequency transceiver circuitry 90 may be mounted to printed circuit board 154 (e.g., using solder). Metal layer 136 may form a metal patch in region P. Path 136' may be formed from an extended portion of layer 136. Path 136' may be coupled to control circuitry 30. Buried metal trace 138 may form a path that couples center electrode 182 of dome switch 132 to control circuitry 30. Inductors 240 (e.g., inductors such as inductors L1 . . . LN and inductor 170 of FIG. 8) may be interposed in paths 136' and 138 between buttons 132 and control circuitry 30 as described in connection with FIG. 8.

Transceiver circuitry 90 may be coupled to metal layer 136 (e.g., the patch in region P) using buried metal trace 176 and via 178. A portion of layer 136 such as signal trace 174 may couple transceiver circuitry 90 to screw 172.

Figure 10:
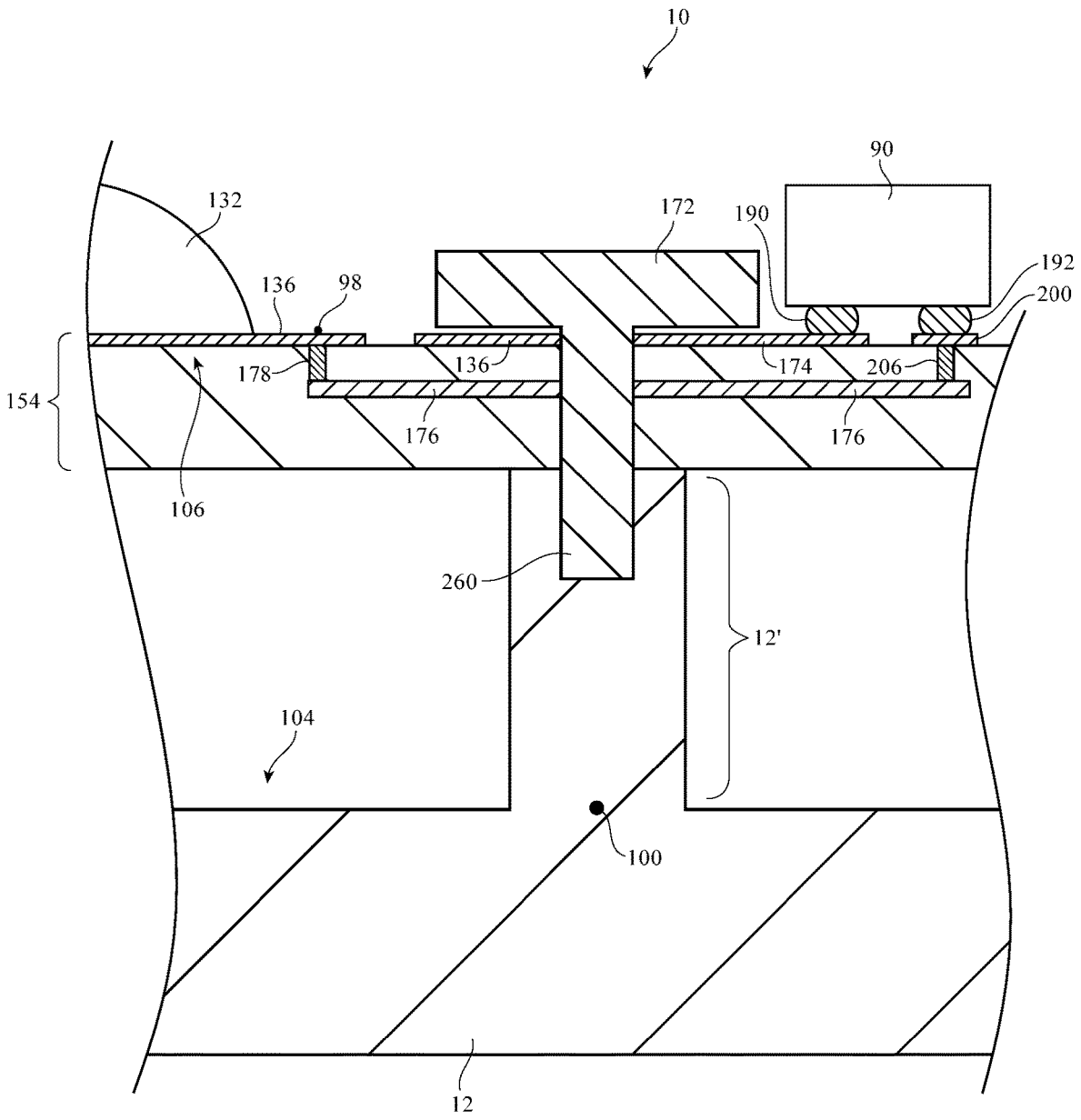
FIG. 10 is a cross-sectional side view of a portion of an electronic device having metal traces that are being used as part of an antenna and as part of a button ground in accordance with an embodiment.

Metal trace 174 may be used to convey antenna signals to a ground antenna feed terminal. Metal trace 176 may be used to convey antenna signals to a positive antenna feed terminal. A cross-sectional side view of printed circuit 154 and other device structures taken along line 210 of FIG. 9 and viewed in direction 212 of FIG. 9 is shown in FIG. 10. As shown in FIG. 10, screw 172 may form a vertical signal path through device 10. Ground antenna signals for antenna 40 may be provided to antenna feed terminal 100 on housing 12, which serves as antenna ground 104. These signals from transceiver circuitry 90 may be routed to ground feed terminal 100 via solder joint 190, metal trace 174 in printed circuit 154, screw 172, and metal housing portion 12' or other conductive structure in device 10 that is coupled to housing 12. Metal housing portion 12' may be configured to form a screw boss having a threaded opening that receives threaded shaft 260 of screw 172. Positive antenna signals for antenna 40 may be provided to positive antenna feed terminal 98 on metal layer 136 of antenna resonating element 106 via solder joint 192, via 206, buried metal trace 176, and via 178 or through other traces in printed circuit 154.

If desired, other signal paths can be used to route signals between transceiver 90 and antenna 40. The use of screw 172 and screw boss 12' to route signals vertically to antenna ground 104 while using horizontal printed circuit board signal paths to route signals to antenna resonating element 106 (i.e., the patch formed from metal layer 136) is merely illustrative.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal wall that serves as an antenna ground for a patch antenna;

a printed circuit mounted in the housing;

a wireless transceiver coupled to the patch antenna;

a button mounted on the printed circuit; and control circuitry coupled to the button, the printed circuit having a metal layer that forms an antenna resonating element for the patch antenna, the antenna resonating element forming a ground electrode for the button and the control circuitry, and the button having an additional electrode separated from the ground electrode and connected to the control circuitry.

2. The electronic device defined in claim 1 wherein the additional electrode comprises a central electrode on the printed circuit, the central electrode being surrounded by the ground electrode.

3. The electronic device defined in claim 2 further comprising a screw that forms a signal path between the printed circuit and the housing, wherein the housing comprises a screw boss that receives the screw.

4. The electronic device defined in claim 1, further comprising:

filter circuitry interposed between the additional electrode and the control circuitry.

5. The electronic device defined in claim 1 wherein the metal layer is configured to form a metal patch for the antenna resonating element, the electronic device further comprising:

an additional button coupled to the control circuitry, the antenna resonating element forming a ground electrode for the additional button.

6. The electronic device defined in claim 1, wherein the ground electrode and the additional electrode are formed on a same surface of the printed circuit and are separated from each other by a gap.

7. The electronic device defined in claim 1, wherein the button includes a switch coupled between the ground electrode and the additional electrode.

8. The electronic device defined in claim 7, wherein the control circuitry is connected to the ground electrode through the switch.

9. An electronic device, comprising:

a housing having a metal portion that serves as an antenna ground for an antenna;

a printed circuit board having a metal layer;

wireless transceiver circuitry mounted to the printed circuit board;

a control circuit mounted to the printed circuit board; and a plurality of buttons mounted to the printed circuit board, wherein each button has an electrode, a compressible dome member formed over the electrode, and a metal coating on the inner surface of the compressible dome member, each metal coating is electrically connected to the metal layer, the metal layer and the metal coating of each button form an antenna resonating element for the antenna, the metal layer has an extended portion that carries signals to the control circuit, and the metal coating of a respective button is configured to directly contact the electrode of that button when that button is pressed.

10. The electronic device defined in claim 9 wherein the metal layer forms a ground electrode shared by each of the plurality of buttons.

11. The electronic device defined in claim 10 wherein the metal portion of the housing includes a rear housing wall, the electronic device further comprising a screw that carries signals between the wireless transceiver circuitry and the rear housing wall.

12. The electronic device defined in claim 9 further comprising filtering circuitry interposed in respective signal paths between the control circuit and each of the plurality of buttons.

13. The electronic device defined in claim 12 further comprising a touch pad that provides touch input from a user to the control circuit.

14. The electronic device defined in claim 9, wherein each of metal coating is electrically connected to the metal layer with solder that directly contacts both the metal layer and the corresponding metal coating.

15. The electronic device defined in claim 9, further comprising:

a first filtering circuit that is disposed along the extend portion of the metal layer; and a second filtering circuit that is interposed between the electrode of the respective button and the control circuit.

16. An electronic device, comprising:

a metal housing that forms an antenna ground in a patch antenna;

a printed circuit board;

a metal patch formed from a metal layer on the printed circuit board, wherein the metal patch forms an antenna resonating element in the patch antenna;

a button mounted to the printed circuit board; and a control circuit mounted to the printed circuit board, wherein the metal patch is configured to convey a button signal between the button and the control circuit.

17. The electronic device defined in claim 16 further comprising:

wireless transceiver circuitry on the printed circuit board that is coupled to the antenna ground through a housing boss in the metal housing and that is coupled to the metal patch through a signal path in the printed circuit board; and a screw that screws into the housing boss and that shorts a metal trace on the printed circuit board to the metal housing.

18. The electronic device defined in claim 16, wherein the control circuit is electrically connected to the button through the metal patch.

19. The electronic device defined in claim 16, further comprising:

filtering circuitry interposed between the button and the control circuit, wherein the button signal conveyed between the button and the control circuit is configured to pass through the filtering circuitry.

20. The electronic device defined in claim 16, wherein the button signal is indicative of when two electrodes for the button are in contact with each other.

* * * * *